US007552968B2

(12) United States Patent
Smith et al.

(10) Patent No.: US 7,552,968 B2
(45) Date of Patent: Jun. 30, 2009

(54) FEET FOR STACKING CHAIR

(75) Inventors: Richard D. Smith, Spanish Fork, UT (US); David J. Laws, Provo, UT (US)

(73) Assignee: Mity-Lite, Inc., Orem, UT (US)

( * ) Notice: Subject to any disclaimer, the term of this patent is extended or adjusted under 35 U.S.C. 154(b) by 435 days.

(21) Appl. No.: 11/411,572

(22) Filed: Apr. 25, 2006

(65) Prior Publication Data

US 2007/0132291 A1 Jun. 14, 2007

Related U.S. Application Data

(60) Provisional application No. 60/749,776, filed on Dec. 12, 2005.

(51) Int. Cl.
*A47C 3/04* (2006.01)

(52) U.S. Cl. ..... 297/239

(58) Field of Classification Search ..... 297/239; 16/42 R, 18 R, 42 T
See application file for complete search history.

(56) References Cited

U.S. PATENT DOCUMENTS

| | | | | |
|---|---|---|---|---|
| 1,408,114 | A | | 2/1922 | Mathieu |
| 1,825,358 | A | | 9/1931 | Scully |
| 1,993,601 | A | | 3/1935 | Goldberg |
| 2,098,888 | A | | 11/1937 | Schadler |
| 2,699,814 | A | | 1/1955 | Kahn |
| 2,874,755 | A | * | 2/1959 | Smith ..... 297/183.1 |
| 2,924,830 | A | | 2/1960 | De Long |
| 2,964,092 | A | | 12/1960 | Rassier |
| 3,025,102 | A | | 3/1962 | Nash |
| 3,246,928 | A | | 4/1966 | Haynes et al. |
| 3,278,227 | A | * | 10/1966 | Rowland ..... 297/239 |
| 3,291,523 | A | | 12/1966 | Krueger |
| 3,586,277 | A | * | 6/1971 | Voris, Jr. ..... 248/146 |
| 3,610,686 | A | | 10/1971 | Caruso |
| 3,695,694 | A | | 10/1972 | Mohr |
| 3,755,853 | A | | 9/1973 | Barile |
| 3,899,207 | A | | 8/1975 | Mueller |
| 4,057,288 | A | | 11/1977 | Schwartz et al. |
| 4,648,653 | A | | 3/1987 | Rowland |
| 4,852,944 | A | | 8/1989 | Hartmann |
| 5,002,337 | A | | 3/1991 | Engel et al. |
| 5,064,247 | A | * | 11/1991 | Clark et al. ..... 297/447.3 |
| 5,383,712 | A | | 1/1995 | Perry |
| 5,863,096 | A | | 1/1999 | Bartlmae |
| 6,095,597 | A | | 8/2000 | Huang |
| 6,742,839 | B2 | | 6/2004 | Piretti |
| 6,866,338 | B2 | | 3/2005 | Mendenhall et al. |

* cited by examiner

*Primary Examiner*—Milton Nelson, Jr.
(74) *Attorney, Agent, or Firm*—Thorpe North & Western LLP

(57) ABSTRACT

A chair foot device for a wire frame chair stackable with other wire frame chairs includes a lower surface disposable on a support surface. An upper surface, opposite the lower surface is sized and shaped to carry the lower surface of an adjacent foot from an adjacently stacked upper chair. The chair foot also includes an alignment protrusion disposed on one of the lower and upper surfaces and an alignment indentation disposed on the other of the lower and upper surfaces. The alignment protrusion is sized and shaped to be receivable within an alignment indentation of a corresponding foot from an adjacently stacked chair. The foot is sized and shaped to carry an applied load from an adjacently stacked upper foot and to transfer the applied load to an adjacent load bearing surface. The foot is also sized and shaped to protect the wire frame chair from damage during stacking.

17 Claims, 7 Drawing Sheets

FEET FOR STACKING CHAIR

This application claims benefit of U.S. Provisional Application 60/749,776 filed Dec. 12, 2005 which is herein incorporated by reference.

BACKGROUND OF THE INVENTION

1. Field of the Invention

The present invention relates generally to chairs that stack and more particularly to nestable stacking chairs.

2. Related Art

Nesting stackable chairs are chairs that can be stacked one on top of another for storage. These chairs typically have a frame that allows one chair to nest on top of another chair. Nesting the stackable chairs minimizes the height of a stack of chairs because the legs of the chairs nest within or around adjacent chairs so that the seats and backrests of the chairs are very close to one another. Additionally, stacking chairs in this way minimizes the floor space required for chair storage since many chairs are stacked on top of a single chair, thereby saving valuable floor space for other things.

Such stackable chairs often have a tubular or wire frame with legs that are spaced apart so as to fit over and adjacent to the legs of an adjacent lower chair in order to nest with an adjacent lower chair. Similarly, one chair can be placed on top of another chair so that lower chair's legs nest within the legs of the upper chair. When properly nested, the seat portion of the upper stacking chair rests upon the seat portion of the adjacent lower chair, and the backrest of the upper stacking chair rests against the backrest of the adjacent lower chair.

Unfortunately, typical nesting stackable chairs are prone to damage because the stacking process can scratch, mar or otherwise damage the chairs. For example, even though the frame of a stacking chair is configured to fit around the frame of another stacking chair, the frame of the upper chair can scratch the frame of the lower chair as the upper chair frame slides onto the lower chair. Moreover, if the upper chair is skewed in relation to the lower chair, the metal frame of the upper chair can contact and damage portions of the lower chair that are more easily damaged, such as a cloth or plastic seat or backrest.

Additionally, the weight of the upper chairs can damage the lower stacked chairs. Since many chairs can be stacked together the weight on the lower chairs can crush and damage the seat and backrest cushions of the lower chairs.

Moreover, a stack of many chairs can easily become unbalanced and fall over. Typically, each successive upper chair in a stack of chairs is offset from the next lower chair in order to allow the backrests of the chairs to rest against the backrest of the lower adjacent chair. Consequently, the stack of chairs leans forward because each successive chair moves the center of gravity of the stack a little farther from the center of gravity of the bottom chair.

Additionally, typical stackable chairs simply slide onto one another allowing the upper chair to rest on whatever surface of the lower chair the upper chair contacts first. This further compounds the alignment issue of a stack of chairs because upper chairs may get skewed during the nesting/stacking process.

SUMMARY OF THE INVENTION

It has been recognized that it would be advantageous to develop a device and method for stacking chairs that maintains the center of gravity of the stack of chairs. In addition, it has been recognized that it would be advantageous to develop a device and method to align stackable chairs during the stacking process and retain the chairs in an aligned stacked position. Additionally, it has been recognized that it would be advantageous to develop a device for stacking nesting stackable chairs that restricts abrasion, rubbing or contact between nested chairs.

The invention provides a chair foot device for a stackable wire frame chair including a lower surface disposable on a support surface. An upper surface, opposite the lower surface can be sized and shaped to carry the lower surface of an adjacent foot from an adjacently stacked upper chair. The chair foot also includes an alignment protrusion disposed on one of the lower and upper surfaces and an alignment indentation disposed on the other of the lower and upper surfaces. The alignment protrusion can be sized and shaped to be receivable within an alignment indentation of a corresponding foot from an adjacently stacked chair. The foot can be sized and shaped to carry an applied load from an adjacently stacked upper foot and to transfer the applied load to an adjacent load bearing surface.

The present invention also provides for a method of stacking chairs including: placing a lower wire frame chair on a support surface, the lower wire frame chair including a plurality of feet coupled to a wire frame; stacking an upper wire frame chair on the lower wire frame chair, the lower wire frame chair nesting within the upper wire frame chair; sliding an inner surface of at least one of the plurality of feet of the upper wire frame chair along a wire frame of the lower wire frame chair; aligning an alignment indentation on at least one foot of one of the lower and upper wire frame chairs with an alignment protrusion on at least one foot of another of the lower and upper wire frame chairs; and resting a lower surface of each of the plurality of feet of the upper wire frame chair upon an upper surface of each of the plurality of feet of the lower wire frame chair.

Additional features and advantages of the invention will be apparent from the detailed description which follows, taken in conjunction with the accompanying drawings, which together illustrate, by way of example, features of the invention.

DETAILED DESCRIPTION

Figure 1:
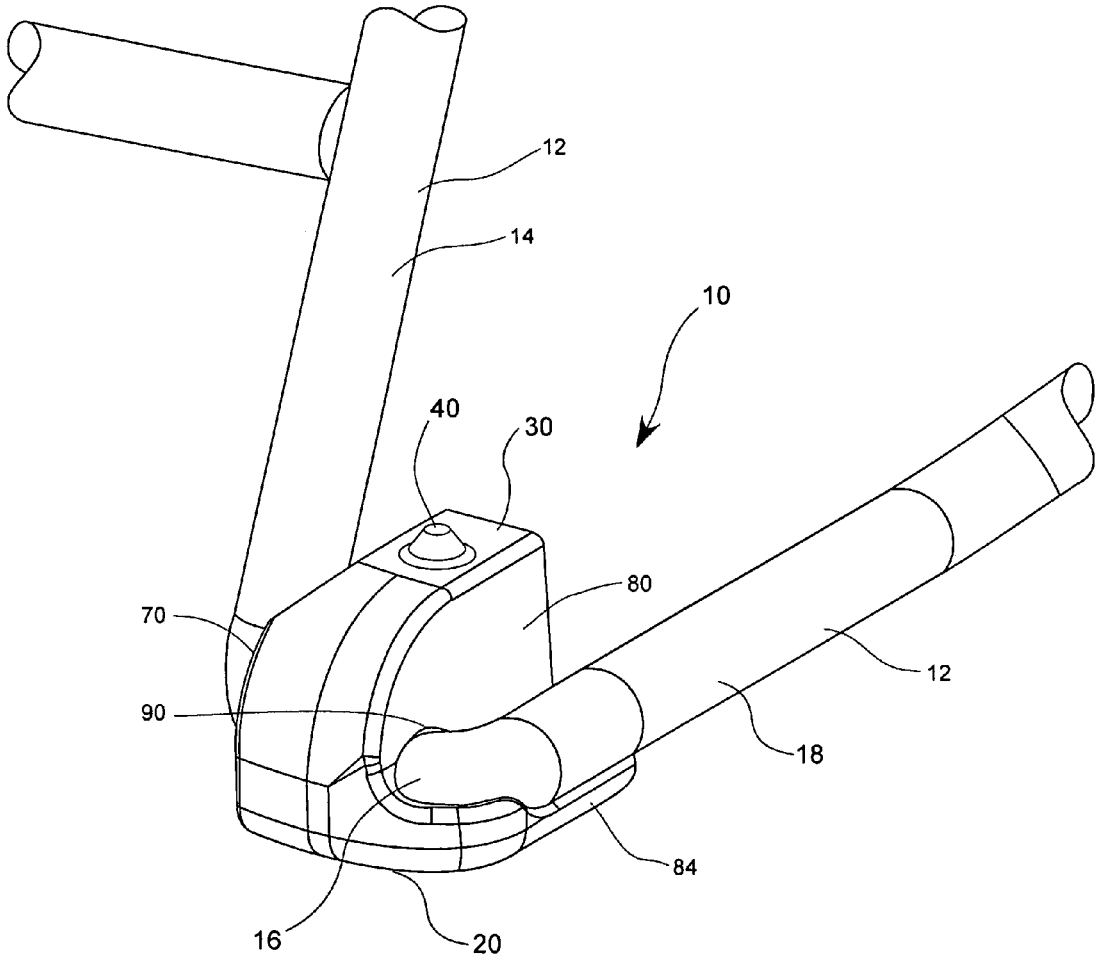
FIG. 1 is a perspective view of a foot device in accordance with an embodiment of the present invention, shown attached to a wire frame chair.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

The present invention generally provides for a foot device for wire frame chairs that are stackable. The foot device couples to the bottom of the chair frame and has a lower surface configured to rest on a support surface and can carry and support the chair. The lower surface can also provide a relatively low friction interface between the chair and the support surface so that the chair can easily be moved by sliding on the support surface. The foot device also has an upper surface opposite the lower surface. The upper surface is configured to support and carry the lower surface of adjacent corresponding foot devices disposed on an upper stacked chair when the upper chair is stacked on a lower chair. The upper surface also has a protrusion extending upward from the upper surface. The bottom surface has an indentation corresponding in size and shape to the protrusion. The indentation in the bottom surface can receive a protrusion from an adjacent foot device disposed on a lower chair when the chair with the foot device is stacked on top of the lower chair. Thus, the protrusion and indentation align the chairs as they are stacked on top of one another and retain the chairs in the stack position.

Figure 2:
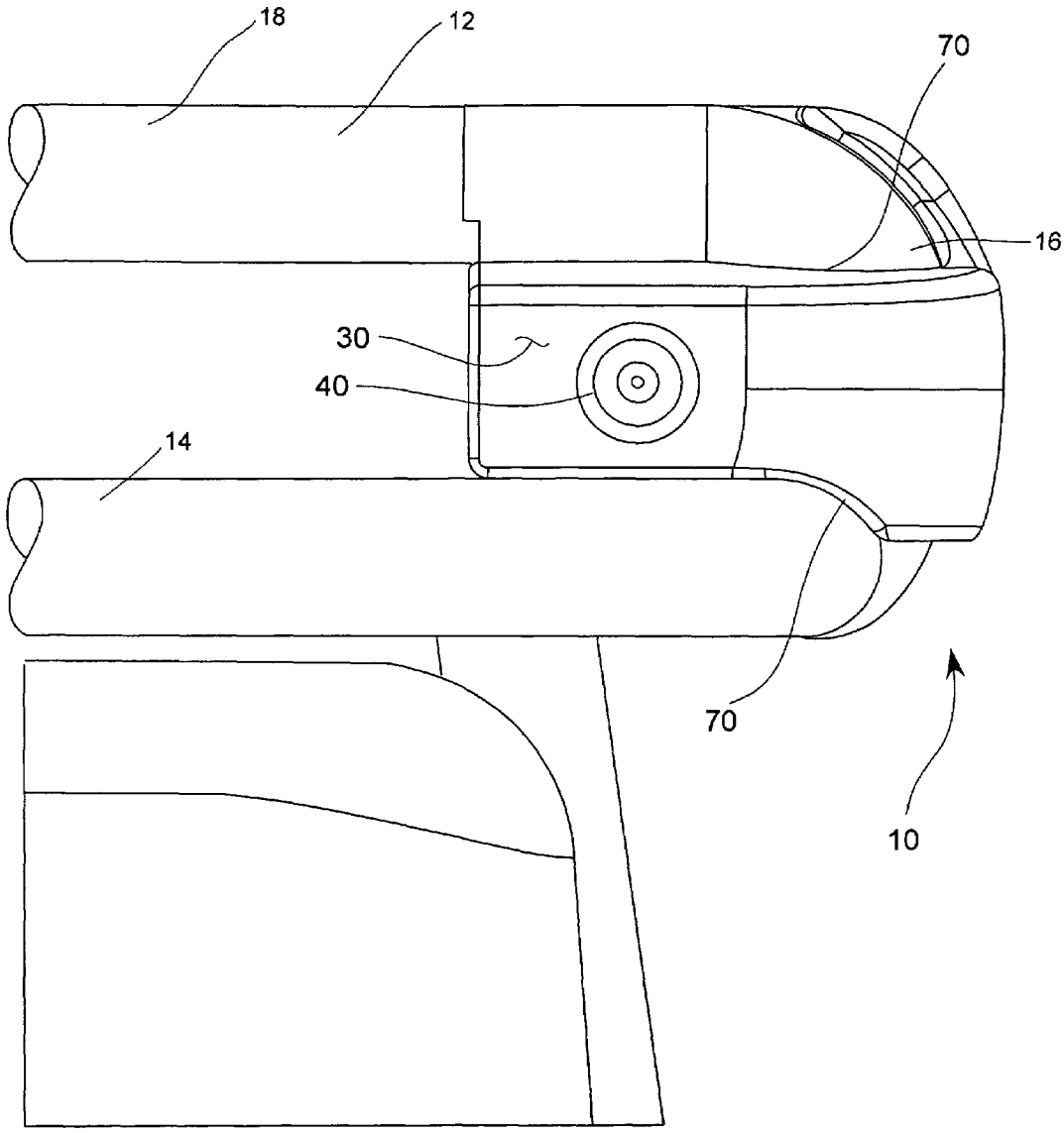
FIG. 2 is a top view of the foot device of FIG. 1.
Figure 3:
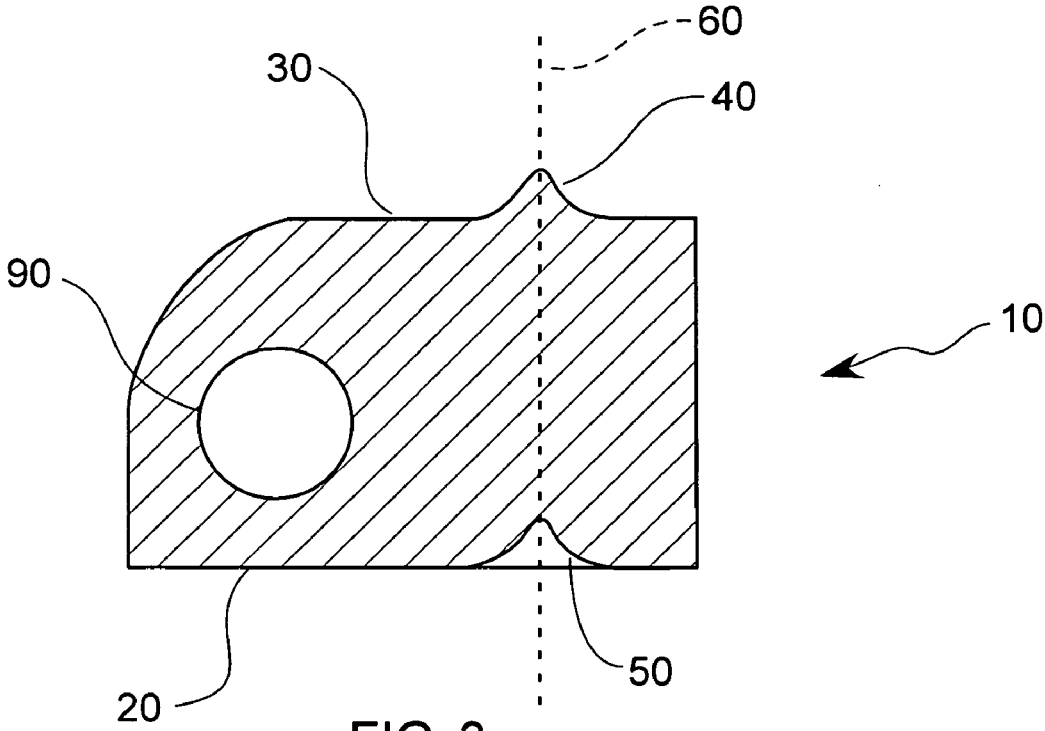
FIG. 3 is a cross section schematic view of the foot device of FIG. 1.

As illustrated in FIGS. 1-3, a chair foot device, indicated generally at 10, in accordance with the present invention is shown for use in aligning and supporting stackable wire frame chairs. The foot device 10 can be coupled to the wire frame 12 at the bottom of the chair. The foot 10 can be formed of plastic. The wire frame 12 can include a vertically inclined leg 14, such as a front or rear leg, and a brace 18 extending from a bottom of the leg 14, such as extending between a front leg and a rear leg on one side of the chair. The leg 14 and brace 18 can define a corner. The foot 10 can be disposed at the corner of the wire frame. In addition, the leg 14 and brace 18 can be off-set with respect to one another, and coupled together by a lateral wire frame member 16.

The foot device 10 can have a lower surface 20 that can be disposed on a support surface or floor. Thus, the lower surface 20 can be the lowermost portion of the chair or wire frame 12. When the lower surface 20 is disposed on a support surface, such as a floor, the lower surface 20 can provide a relatively low friction contact interface with the support surface to allow the chair to glide or slide on the support surface. In this way, the chair can easily be moved by sliding the foot device 10 of the chair over the support surface. Additionally, a stack of chairs can also be easily moved by sliding the foot device 10 of the bottom chair in the stack over the support surface. The lower surface 20 can be substantially flat and oriented horizontally, as shown, to facilitate low friction engagement with the floor. In addition, the lower surface 20 can be formed of plastic to facilitate sliding on the floor. Alternatively, the lower surface can be non-flat, or can be shaped to create a high friction or gripping surface with the floor. In addition, such a lower surface could be formed of a higher friction material, such as rubber or the like.

The foot device 10 can also have an upper surface 30. The upper surface 30 can be disposed opposite the lower surface 20, and can be horizontal and flat to carry the lower surface 20 of an adjacent foot 10 from an adjacently stacked upper chair (see FIGS. 5 and 9). In this way, the foot device 10 can carry an applied load from an adjacent upper foot 10 and transfer the applied load to an adjacent corresponding lower foot 10. Having the foot device 10 carry the load and weight from an adjacent upper foot 10 protects the wire frame 12 and chair from damage. For example, the foot device 10 can maintain a spatial relationship between adjacently stacked chairs so that the seats and back rests of the chairs do not carry the load of the upper stacked chairs.

The foot device 10 can also have an alignment protrusion 40 and an alignment indentation 50. The alignment protrusion 40 can extend above the upper surface 30 between approximately ¼ to ½ inches. Similarly, the alignment indentation 50 can extend into the lower surface 20 between approximately ¼ to ½ inches. The alignment indentation 50 can be sized and shaped to correspond to the size and shape of the alignment protrusion 40. For example, the alignment protrusion 40 can be conical and can extending into the alignment indentation 50 which can also be conical.

It will be appreciated that the alignment protrusion 40 can have other shapes and sizes so that the alignment indentation 50 can receive an alignment protrusion 40 of an adjacent foot from an adjacently stacked chair. For example, the alignment protrusion 40 can be cylindrical with a hemispherical top, pyramidal, tetragonal, or the like. Additionally, the alignment protrusion can be shaped so as to interface with a support surface, such as a floor, upon which the chair can rest. The alignment indentation 50 can have a corresponding shape to the alignment protrusion 40.

A protrusion 40 with a larger base than top, such as a cone, pyramid, or the like, and a correspondingly shaped indentation 50 can provide several advantages in stacking chairs having the foot device 10 of the present invention. For example, a conical or similar shape can shift the position of adjacent upper and lower feet with respect to one another in order to align the chairs in a desired alignment as an upper chair is lowered onto a lower chair. Additionally, a conical shape can resist unwanted horizontal or lateral movement of stacked chairs, yet easily allows intentional removal of chairs from the stack by lifting the chairs vertically over the protrusions of adjacent lower chairs.

It will be appreciated that the lower surface 20 can have either the alignment indentation or the alignment protrusion disposed on the lower surface, and that the other of the alignment protrusion or alignment indentation can be disposed on the upper surface 30. In the case where the protrusion is placed on the lower surface it can be configured to interface with the floor or other support surface. In the case where the indentation is placed on the lower surface, the portion of the lower surface not indented can be configured to interface with the floor. Thus, in one aspect, the alignment indentation 50 can be extend into the lower surface 20 and the alignment protrusion 40 can be protrude from the upper surface 30, as shown in FIGS. 1-3.

The alignment indentation 50 and the alignment protrusion 40 can be centered along a substantially common vertical axis, shown by dashed line 60. Centering the alignment protrusion 40 and the alignment indentation 50 about a substantially common vertical axis 60 can minimize the shifting of the center of gravity of a stack of chairs from the center of gravity of the lowermost chair. Thus, the foot device 10 of the present invention provides substantially maintaining the center of gravity of a stack of chairs, thereby allowing a greater number of chairs to be stacked.

The foot device 10 can also have an inner side 70 and an opposite outer side 80 disposed between the lower 20 and upper 30 surfaces. The inner side 70 can be sized and shaped to guide the wire frame 12 into a stacked position with an adjacently stacked lower chair. The outer side 80 can have a ledge 84 extending along the outer side 80. The inner side 70 of the foot device 10 can reduce contact between the wire frames 12 and other parts of an adjacent stacked wire frame chair, thereby protecting the wire frame 12, backrest, and seat of the chair from scrapes, nicks, and marring by contact with other chairs.

The foot device 10 can also have aperture 90 sized and shaped to carry a portion 16 of the wire frame 12. The aperture 90 can be a transverse bore or hole extending from the inner side 70 to the outer side 80. A portion 16 of the wire frame 12 can fit through the aperture 90, and the foot device 10 can enclose around the portion 16 of the wire frame 12 to couple the foot device 10 to the wire frame 12. Thus, in one aspect, a portion of the wire frame 12, such as a leg 14 of the chair, can extend downward along the inner surface 70 of the foot device 10, and can bend into the transverse bore 90 which extends laterally with respect to the chair frame. The wire frame 12 can exit the transverse bore at the outer edge 80, and can bend toward the back of the chair frame. The wire frame 12 can extend from the transverse bore along the outer surface 80 and can be carried by the ledge 84. Thus, the ledge 84 can be positioned to support a brace 18 of the wire frame 12 extending out of the transverse bore 90. The ledge 84 can be disposed between the wire frame 12, or the brace 18 and lateral wire frame member 16, to maintain the wire frame 12 off of the floor and make the lower surface 20 the lowermost portion of the chair.

It will be appreciated that the aperture 90 is one means for coupling the foot device 10 to the chair. Other means for coupling the foot 10 to the chair can also be used so that the coupling means do not interfere with the stacking or nesting of the chairs.

Figure 4:
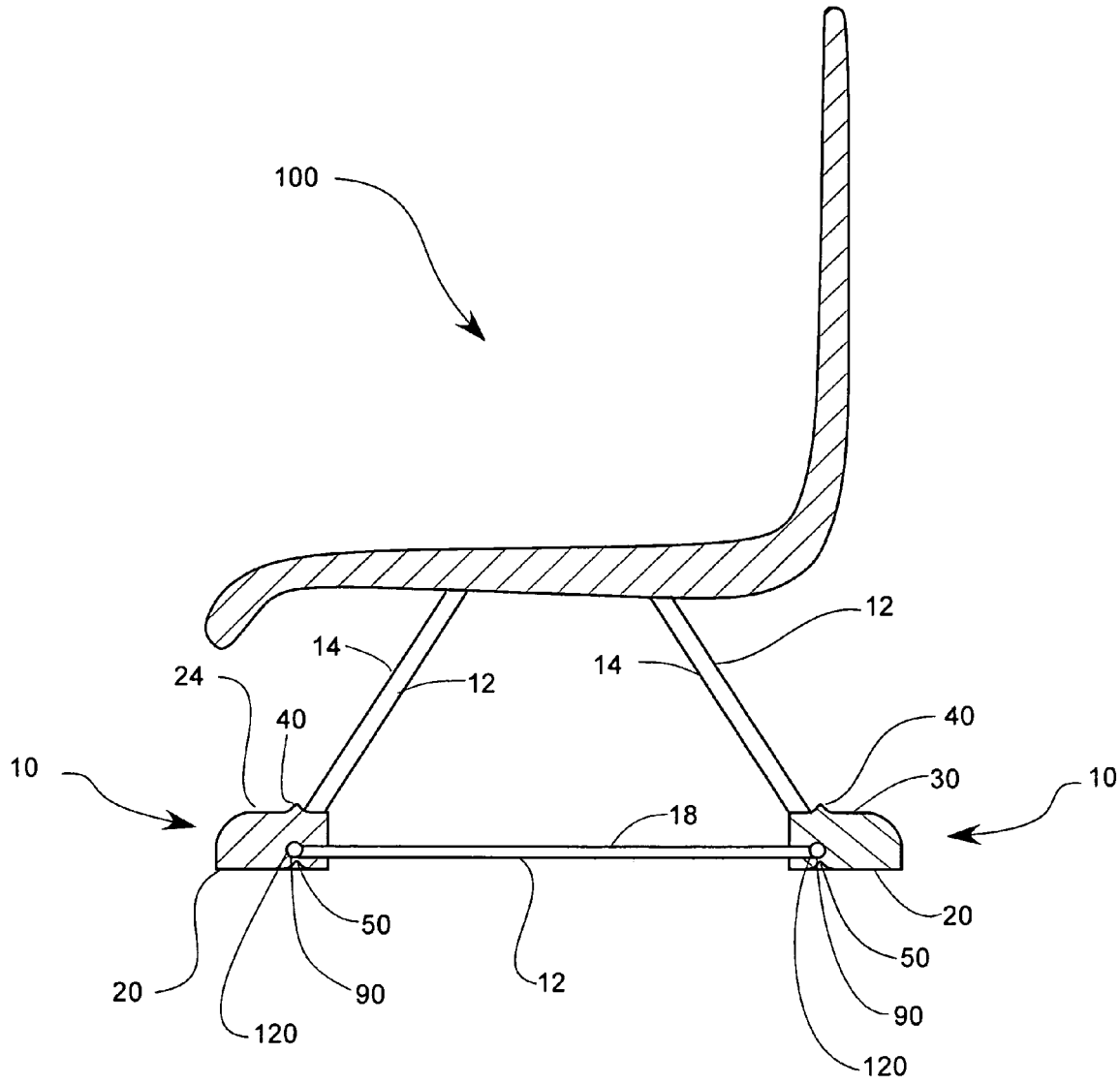
FIG. 4 is a cross section of a wire frame chair having a plurality of the foot devices of FIG. 1.

Illustrated in FIG. 4, a nesting, stackable tubular frame chair, shown generally at 100 is shown having a plurality of foot devices 10, as previously described, to aid in stacking the chair 100 with other similar chairs. For example, a foot 10 can be disposed at each lower corner of the chair. The chair 100 can have a wire frame 12 that is configured to nest between an upper chair and a lower chair.

Additionally, the chair 100 can have a plurality of foot devices 10, as described above. Specifically, each foot device 10 can have a lower surface 20 disposable on a support surface or adjacent lower foot, and an upper surface 30 disposed opposite the lower surface that can carry the lower surface 20 of an adjacent stacked foot 10 from an adjacently stacked upper chair. Each foot can also have an alignment protrusion 40 and an alignment indentation 50 disposed on one of the lower and upper surfaces and sized. The alignment protrusion 40 and alignment indentation 50 can be shaped and sized to receive an alignment protrusion 40 or alignment indentation 50 of a corresponding foot from an adjacently stacked lower chair. The foot 10 can also be sized and shaped to carry an applied load from an adjacently stacked upper foot and to transfer the applied load to an adjacent stacked lower foot, or support surface.

The protrusion 40 and indentation 50 of each foot device 10 can align and retain upper and lower chairs in a stack of chairs. Additionally, the lower surface 20 of each foot device 10 can advantageously support and carry the load or weight of chairs stacked in a stack of chairs. Moreover, the lower surface 20 of the feet 10 can provide a low friction interface between the each foot 10 and a support surface so that the chair 100, or stack of chairs can easily be moved by sliding the chair or stack of chairs along the support surface.

The wire frame 12 of the wire frame chair 100 can also include a vertically inclined leg 14 and a brace 18. The brace 18 can extend from a lower end of the leg 14 to define a corner 120. The vertically inclined leg 14 and the brace 18 can be laterally offset with respect to one another. A foot device 10 can be coupled to the wire frame 12 substantially at the corner 120 of the chair leg 14 by enclosing the wire frame 18 in a transverse bore 90.

The transverse bore 90 can extend from an inner side 70 to an outer side 80 of each of the plurality of feet 10. The transverse bore 90 can be sized and shaped to receive the lower end of the vertically inclined leg 14 at the inner side 70 of the foot device 10, and an end of the brace 18 at the outer side. A lateral wire frame member 14 can extend through the transverse bore 90 between the lower end of the leg 16 and the end of the brace 18.

Figure 5:
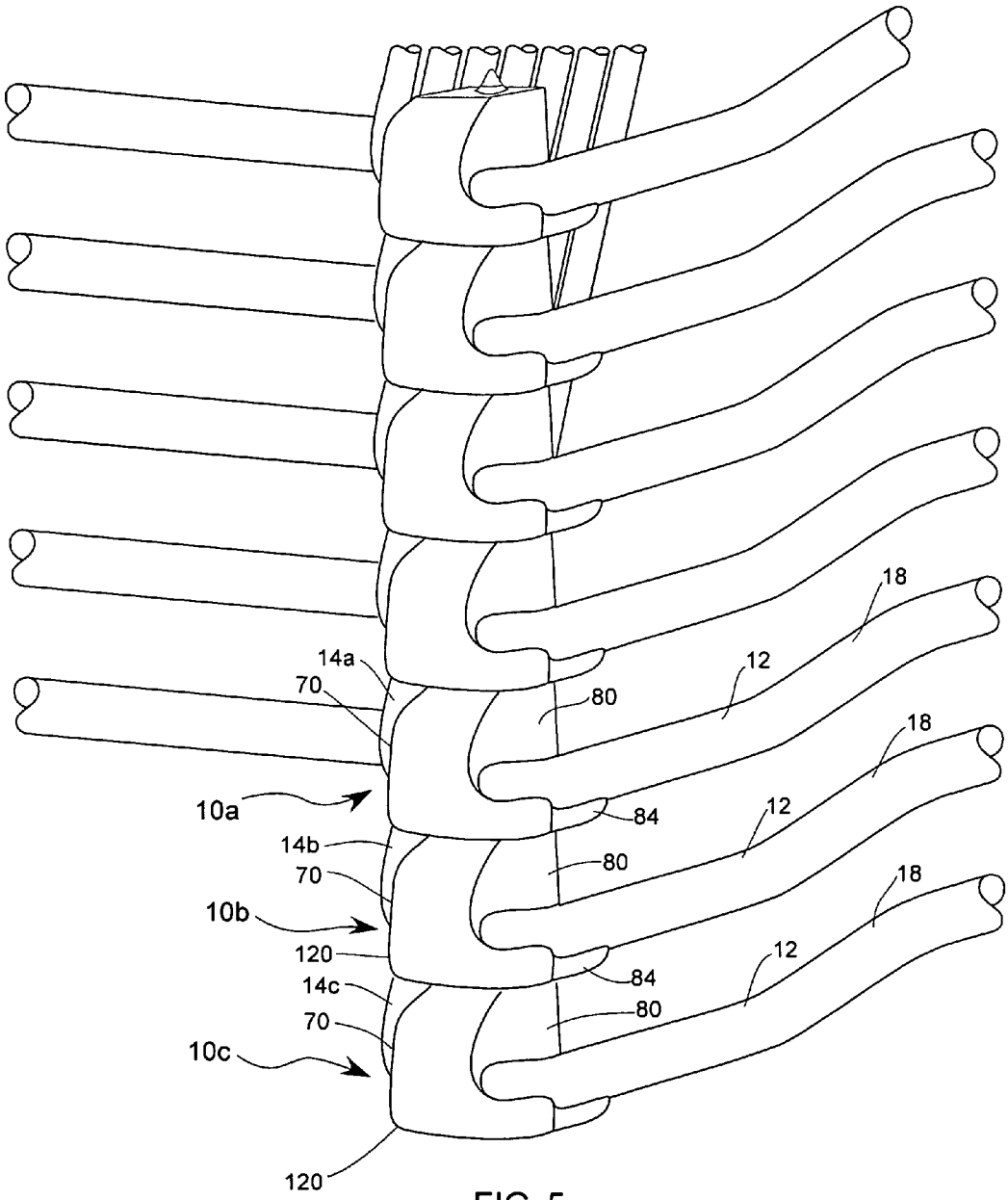
FIG. 5 is a partial perspective view of a plurality of the foot devices of FIG. 1, shown attached to chairs in a stacked configuration.
Figure 6:
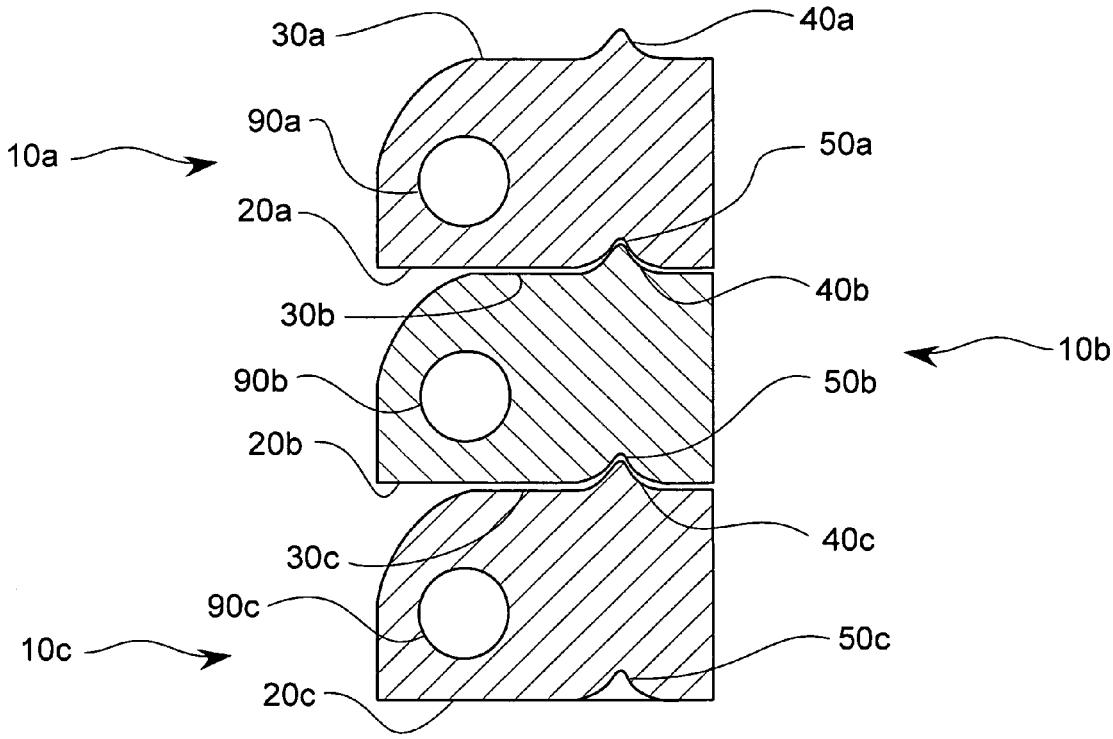
FIG. 6 is a cross section schematic view of a plurality of foot devices of FIG. 1, shown in a stacked configuration.

Referring to FIGS. 5-6, the foot device 10 of the present invention is shown in a stack of chairs. As one foot 10*b* is stacked on top of a lower foot 10*c*, the alignment indentation 50*b* can align with and retain the alignment protrusion 40*c* of an adjacent lower foot 10*c*. Similarly, the alignment indentation 50*a* of an adjacent upper foot 10*a* can align with and be placed over the protrusion 40*b* of the foot 10*b*. In this way, the alignment protrusion 40*b* and alignment indentation 50*b* can align the feet 10*a* and 10*c* of adjacently stacked upper and lower chairs, thereby minimizing any leaning of the stack of chairs as the stack of chairs gets higher. The alignment protrusion 40 and alignment indentation 50 also prevent inadvertent shifting of adjacently stacked chairs during stacking or subsequent movement of the stack of chairs.

As described above, each foot device 10*a*, 10*b*, and 10*c* can also include a ledge 84 that can extend along the outer side 80 of the foot device 10. The ledge 84 can be positioned to support the brace 18 of the wire frame chair that extends out of the transverse bore 90. Additionally, the inner side surface 70 can be sized and shaped to guide the wire frame 14*a*, 14*b*, and 14*c* of the chairs into a stacked position with an adjacently stacked lower chair.

Thus, wire frame chairs having a plurality of foot devices 10 can be easily stacked into stacks of chairs for storage and transportation. Moreover, more chairs can be stacked because the foot device 10 reduces misalignment or shifting of the center of gravity of upper stacked chairs.

Figure 7:
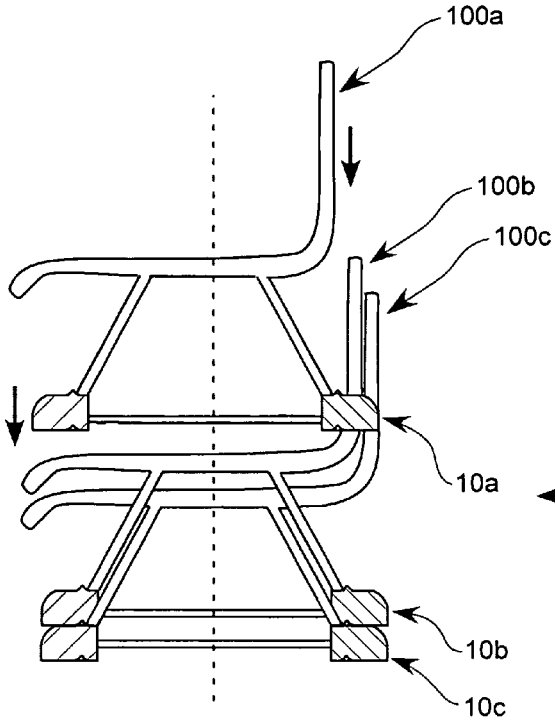
FIGS. 7-9 illustrate a method for stacking a plurality of stackable chairs having a plurality of the foot devices of FIG. 1.
Figure 8:
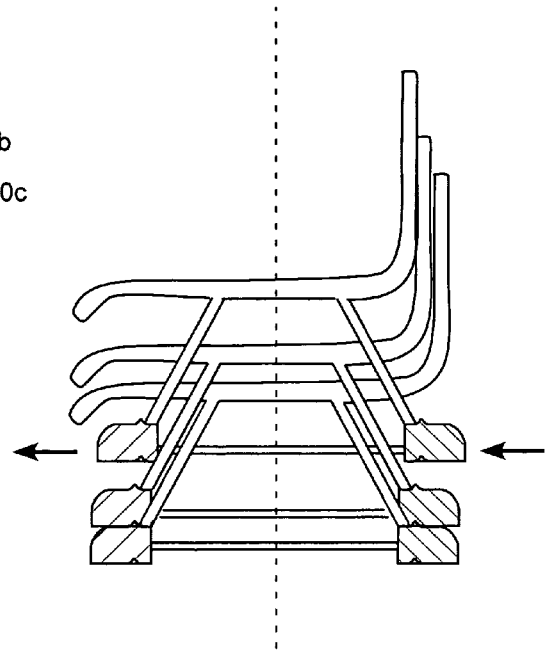
Figure 9:
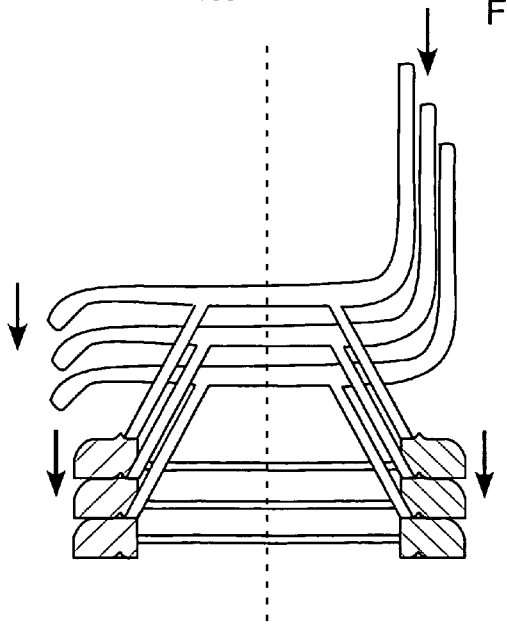

Referring to FIGS. 7-9, the present invention also provides for a method of stacking chairs including providing a plurality of stackable chairs. Each chair can have a plurality of feet, and each foot can have an alignment protrusion extending away from an upper surface and an alignment aperture disposed in a lowermost surface. One of the plurality of stackable chairs can be placed on top of another of the plurality of stackable chairs, as shown in FIG. 7. The alignment aperture of each of the plurality of feet of the top stackable chair can be aligned with the alignment protrusion of each of the plurality of feet of the bottom stackable chair, as shown in FIG. 8. The upper chair can be pushed down onto the lower chair, as shown in FIG. 9, so that the lower most surface of each of the plurality of feet of the upper chair rests upon the upper surface of each of the plurality of feet of the lower chair. Thus, the alignment aperture of each of the plurality of feet of the upper chair can receive the alignment protrusions of each of the plurality of feet of the lower chair.

The inside surface of the feet can slide or track along the outside edge of the legs or wire as one chair is removed or stacked on another in order to guide and protect the metal or wire of the legs.

In summary, the foot device of the present invention generally provides several functions including aligning the chairs when stacked; bearing the load of the stacked chairs; and spacing the chairs when stacked for protection against. With the feet bearing the load of the stacked chairs, the stacked chairs resist the "wedge" effect because the feet have horizontal stacking surfaces. Thus, the chairs are easier to remove from the stack, and resist marring. In addition, stress on the steel or wire of the legs is reduced. Spacing of the chairs by the feet 10 when stacked also resists marring of the wire frame and protects the legs of the chair.

It is to be understood that the above-referenced arrangements are only illustrative of the application for the principles of the present invention. Numerous modifications and alternative arrangements can be devised without departing from the spirit and scope of the present invention. While the present invention has been shown in the drawings and fully described above with particularity and detail in connection with what is presently deemed to be the most practical and preferred embodiment(s) of the invention, it will be apparent to those of ordinary skill in the art that numerous modifications can be made without departing from the principles and concepts of the invention as set forth herein.

What is claimed is:

1. A nesting wire frame chair stackable with other wire frame chairs, comprising:

a) a wire frame, stackable between an upper chair and a lower chair; and b) a plurality of feet, coupled to the wire frame, each foot comprising:

i) a lower surface, disposable on a support surface and disposable on an upper surface of an adjacent stacked foot from an adjacently stacked lower chair;

ii) an upper surface, opposite the lower surface, and configured to carry the lower surface of an adjacent stacked foot from an adjacently stacked upper chair and support an applied load therefrom;

ii) an alignment protrusion and an alignment indentation, each disposed on one of the lower and upper surfaces, and sized and shaped with an alignment protrusion of a corresponding foot from an adjacently stacked chair receivable with the alignment indentation; and iv) the foot being sized and shaped to carry an applied load from an adjacently stacked upper foot and to transfer the applied load to an adjacent stacked lower foot.

2. A chair in accordance with claim 1, wherein the wire frame includes a vertically inclined leg and a horizontal brace extending from a lower end of the leg defining a corner, the vertically inclined leg and the brace being laterally offset with respect to one another, and with one of the plurality of feet being disposed at the corner.

3. A chair in accordance with claim 2, wherein each of the plurality of feet further comprises:

a transverse bore, extending from an inner side to an outer side of the plurality of feet and configured to receive the lower end of the vertically inclined leg at the inner side and an end of the brace at the outer side with a lateral wire frame member extending therebetween.

4. A chair in accordance with claim 3, wherein each of the plurality of feet further comprises:

a ledge extending along the outer side, positioned to support the brace of the wire frame chair extending out of the transverse bore.

5. A chair in accordance with claim 3, wherein the inner side is sized and shaped to guide the wire frame chair into a stacked position with an adjacently stacked lower chair.

6. A chair in accordance with claim 1, wherein the alignment indentation and the alignment protrusion are centered along a common, substantially vertical axis to substantially maintain the center of gravity of the wire frame chair when stacked with other chairs.

7. A method of stacking chairs, comprising:

a) placing a lower wire frame chair on a support surface, the lower wire frame chair including a plurality of feet coupled to a wire frame;

b) stacking an upper wire frame chair on the lower wire frame chair, the lower wire frame chair nesting adjacent to the upper wire frame chair;

c) sliding an inner surface of at least one of a plurality of feet of the upper wire frame chair along a wire frame of the lower wire frame chair;

d) aligning an alignment indentation on at least one foot of one of the lower and upper wire frame chairs with an alignment protrusion on at least one foot of another of the lower and upper wire frame chairs; and e) resting a lower surface of each of the plurality of feet of the upper wire frame chair upon an upper surface of each of the plurality of feet of the lower wire frame chair.

8. A method in accordance with claim 7, further comprising:

transferring the weight of the upper wire frame chair to the feet of the lower wire frame chair, and from the feet of the lower wire frame chair to the support surface.

9. A method in accordance with claim 7, further comprising:

removing an upper stacked wire frame chair from a lower wire frame chair to unstack the wire frame chairs.

10. A method in accordance with claim 7, wherein the upper and lower wire frame chairs each have a wire frame that includes a vertically inclined leg and a horizontal brace extending from a lower end of the leg defining a corner, the vertically inclined leg and the brace being laterally offset with respect to one another, and with one of the plurality of feet being disposed at the corner.

11. A method in accordance with claim 10, wherein each of the plurality of feet further comprises:

a transverse bore, extending from an inner side to an outer side of the plurality of feet, and configured to receive the lower end of the vertically inclined leg at the inner side and an end of the brace at the outer side with a lateral wire frame member extending therebetween.

12. A method in accordance with claim 11, wherein each of the plurality of feet further comprises:

a ledge extending along the outer side of the foot, positioned to support the brace of the wire frame chair extending out of the transverse bore.

13. A plurality of nesting and stackable wire frame chairs stackable with one another, each chair comprising:

a) a wire frame, stackable between an upper chair and a lower chair, and including a vertically inclined leg and a horizontal brace extending from a lower end of the leg defining a corner, the vertically inclined leg and the horizontal brace being laterally offset with respect to one another; and b) a plurality of feet, coupled to the wire frame, with at least one of the plurality of feet being disposed at the corner, and each foot comprising:

i) a lower surface, disposable on a support surface and disposable on an upper surface of an adjacent stacked foot from an adjacently stacked lower chair;

ii) an upper surface, opposite the lower surface, and configured to carry the lower surface of an adjacent stacked foot from an adjacently stacked upper chair and support an applied load therefrom;

ii) an alignment protrusion and an alignment indentation, each disposed on one of the lower and upper surfaces, and sized and shaped with an alignment protrusion of a corresponding foot from an adjacently stacked chair receivable with the alignment indentation; and iv) the foot being sized and shaped to carry an applied load from an adjacently stacked upper foot and to transfer the applied load to an adjacent stacked lower foot.

14. A chair in accordance with claim 13, wherein each of the plurality of feet further comprises:

a transverse bore, extending from an inner side to an outer side of the plurality of feet, and configured to receive the lower end of the vertically inclined leg at the inner side and an end of the brace at the outer side with a lateral wire frame member extending therebetween.

15. A chair in accordance with claim 14, wherein each of the plurality of feet further comprises:

a ledge extending along the outer side of the foot device, positioned to support the brace of the wire frame chair extending out of the transverse bore.

16. A chair in accordance with claim 14, wherein the inner side is sized and shaped to guide the wire frame chair into a stacked position with an adjacently stacked lower chair.

17. A chair in accordance with claim 13, wherein the alignment indentation and the alignment protrusion are centered along a common, substantially vertical axis to substantially maintain the center of gravity of the wire frame chair when stacked with other chairs.

* * * * *